US009964310B2

(12) United States Patent
Reed

(10) Patent No.: US 9,964,310 B2
(45) Date of Patent: May 8, 2018

(54) FUEL STOVE

(71) Applicant: 509 Fabrications, Inc., Mead, WA (US)

(72) Inventor: Frank Reed, Hayden, ID (US)

(73) Assignee: 509 Fabrications, Inc., Mead, WA (US)

( * ) Notice: Subject to any disclaimer, the term of this patent is extended or adjusted under 35 U.S.C. 154(b) by 344 days.

(21) Appl. No.: 14/945,355

(22) Filed: Nov. 18, 2015

(65) Prior Publication Data

US 2017/0138602 A1 May 18, 2017

(51) Int. Cl.

| | |
|---|---|
| ***F24B 5/02*** | (2006.01) |
| ***F24B 7/00*** | (2006.01) |
| ***F24H 3/00*** | (2006.01) |
| ***F24H 9/00*** | (2006.01) |

(52) U.S. Cl.

CPC ..... *F24B 7/005* (2013.01); *F24B 5/021* (2013.01); *F24H 3/008* (2013.01); *F24H 9/0073* (2013.01)

(58) Field of Classification Search

CPC ..... F24H 3/008; F24B 7/005

USPC ..... 126/77, 61, 146; 110/102

See application file for complete search history.

(56) References Cited

U.S. PATENT DOCUMENTS

| | | | | | |
|---|---|---|---|---|---|
| 4,212,634 | A * | 7/1980 | Mitchell | A24B 1/02 | 110/260 |
| 4,228,783 | A * | 10/1980 | Kalenian | F24H 3/088 | 126/112 |
| 4,309,965 | A * | 1/1982 | Hill | F23B 1/36 | 110/234 |
| 4,332,235 | A * | 6/1982 | Hannebaum | F24B 1/181 | 126/146 |
| 4,926,797 | A * | 5/1990 | Butler | F24H 1/26 | 110/234 |
| 6,067,979 | A * | 5/2000 | Jaasma | F23K 3/06 | 110/116 |
| 2007/0157858 | A1 * | 7/2007 | Gagner | F23B 30/10 | 110/102 |

* cited by examiner

*Primary Examiner* — Avinash Savani
(74) *Attorney, Agent, or Firm* — Lee & Hayes, PLLC

(57) ABSTRACT

Apparatuses for burning a burnable fuel source, and methods of operating the same, are disclosed. The apparatuses may include a housing defining a chamber and a tube extending through the housing and disposed at least partially within the chamber of the housing, the tube accommodating a burnable fuel source. A tray may be disposed within the chamber and accommodating at least a portion of the burnable fuel source when received within the tube. A refractory brick may be disposed on at least a portion of the tray, and a plurality of pipes may be disposed within the housing such that, upon actuation of the apparatuses, heat from the burnable fuel source contacts the plurality of pipes. The apparatuses may also include an air outlet in the first housing configured to allow air from within the chamber to exit the chamber.

17 Claims, 12 Drawing Sheets

FUEL STOVE

BACKGROUND

Wood-burning stoves are used to heat homes and other enclosures. In a typical wood-burning stove, such as that installed in a home, the stove may include a container for holding pieces of chopped wood, and an exhaust pipe. The exhaust pipe typically runs from the top of the stove through the roof or side wall of the home. To use the wood-burning stove, a user stacks wood within the stove, lights the wood such that a fire starts, closes the front door or port, and then waits until the fire reaches a sufficient volume to heat the metal wall of the stove. The metal wall of the stove releases heat into the air outside the stove, heating the room where the stove is located. The stove may also have vents or other openings to allow the heated air within the stove to move from the stove to the room where the stove is located. Unused heated air exits the stove through the exhaust pipe. Ash from the burnt wood may stay in the stove, exit through the exhaust pipe, or be expelled into the room. When the wood within the stove is consumed by the fire, the user must open the front door and place new wood into the stove to keep the fire going or to start a new fire.

The wood-burning stove described above suffers from several drawbacks. For example, adding wood to the stove requires the user to open the front door and place more wood into the stove, which may be dangerous to the operator, requires the user to maintain the fire every few hours or even more frequently, and allows ash, sparks, and other unwanted particulates to exit the stove when the door is opened. Also, the outer surface of the stove itself, when in operation, may reach very high temperatures and may be dangerous to persons who contact the stove and may damage property that is near the stove, such as walls, ceilings, furniture, and other personal property. Furthermore, installation requires costly materials and labor to properly vent the exhaust pipe, typically requiring a hole to be cut in the ceiling and roof of the home. Lastly, the stove and exhaust pipe must be periodically cleaned, requiring the stove to be taken out of operation during cleaning.

BRIEF DESCRIPTION OF THE DRAWINGS

The detailed description is set forth below with reference to the accompanying figures. In the figures, the left-most digit(s) of a reference number identifies the figure in which the reference number first appears. The use of the same reference numbers in different figures indicates similar or identical items. The apparatuses depicted in the accompanying figures are not to scale and components within the figures may be depicted not to scale with each other.

DETAILED DESCRIPTION

Overview

Figure 1:
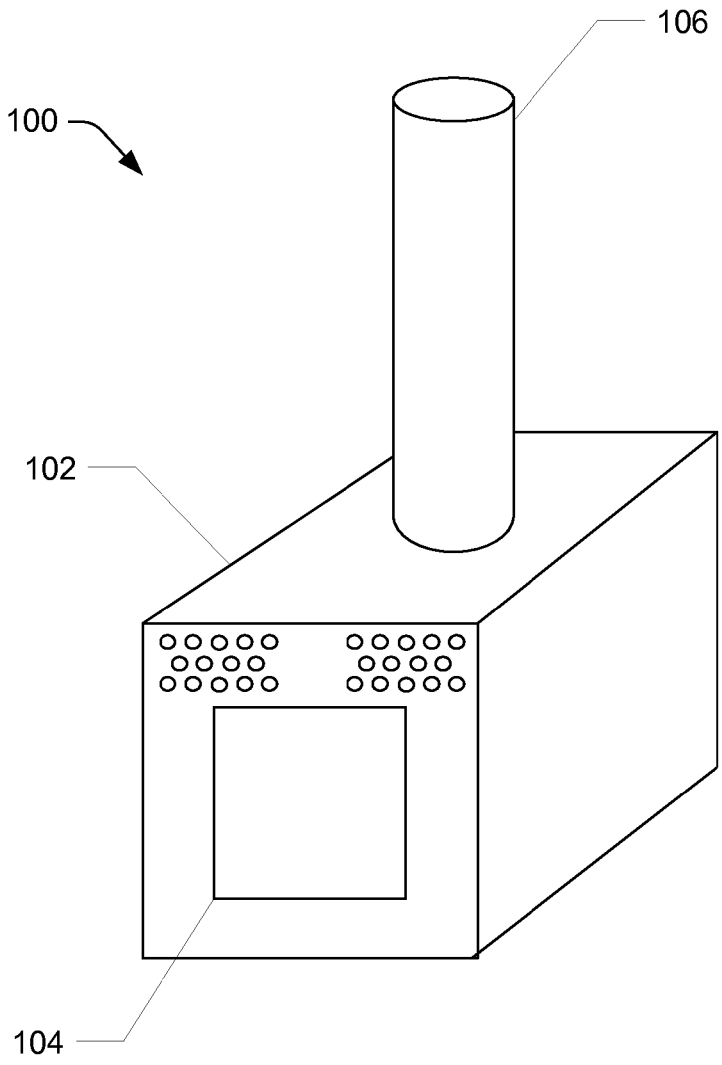
FIG. 1 illustrates a perspective view of an embodiment of an apparatus configured to burn a burnable fuel source.

This disclosure describes example apparatuses for burning a fuel source, and methods of operating such apparatuses.

In one example, the apparatus may include a housing that holds a tray and one or more refractory bricks. The tray and the refractory bricks may be configured to receive a burnable fuel source, such as, for example, a densified fuel log. A tube may extend through the housing, such as through the top of the housing, and terminate within the housing and above the tray and refractory bricks. The burnable fuel source may be placed into the tube and allowed to fall through the tube and onto the tray. The tube may be positioned above the tray such that only a portion of the burnable fuel source is exposed, while the remainder of the burnable fuel source is maintained within the tube. When the burnable fuel source is heated and ignites, the burnable fuel source may burn and the fire therefrom may be contained to only the area of the tray and refractory bricks. By so doing, the fire from the burnable fuel source may be limited to a small area of the housing bordered by the refractory bricks; this area may be known as a "fire box." This may prevent the sides of the apparatus from reaching unsafe temperatures, which could cause personal injury or property damage.

In another embodiment, the housing may include an air inlet, which allows air to flow into the housing, and an air outlet, which allows air to flow out of the housing. An exit fan may be configured to move air out of the housing through the air outlet. In such an embodiment, the exit fan may create a negative pressure within the housing and cause air to be sucked or otherwise moved into the housing from the air inlet. By so doing, the negative pressure within the housing may prevent air, ash, and other contaminants to enter the room where the apparatus is located when the front door of the apparatus or tube lid is opened.

In another embodiment, the housing may include a plurality of pipes disposed such that heat from the burnable fuel source contacts the plurality of pipes when the apparatus is in use. The heated air may heat the plurality of pipes and the air within the plurality of pipes. A deflector plate may be positioned within the housing to deflect heated air from the tray toward the plurality of pipes. By so doing, the heated air from within the housing may be directed toward the plurality of pipes and away from other portions of the housing such as side walls.

In another embodiment, a shell may be positioned around at least a portion of the housing. The shell may be configured to surround a second housing, also referred to herein as an ash collector. The ash collector may be positioned to accept air from the air outlet in the first housing. The accepted air may flow past an array of plates, which may be positioned to increase the distance required for the accepted air to travel. A second array of plates may also be disposed within the ash collector to further increase the distance required for the accepted air to travel. The array of plates, and positioning thereof, may promote ash and other particulates within the air to accumulate on the array of plates, thereby decreasing the amount of ash and other particulates present in the air as the air exits the apparatus.

In another embodiment, a circulating fan may be positioned to move ambient air from outside the apparatus through the plurality of pipes and out the front of the apparatus. The temperature of the air may increase as the air moves through the plurality of pipes. The heated air, when it exits the plurality of pipes on the front of the apparatus, may enter the room where the apparatus is located, heating the air within that room. The circulating fan may also move air from within the space between the shell and the housing. The air between the shell and the housing may be heated by radiant heat from the housing.

In yet another embodiment, a method of operating the apparatuses described herein may include placing a burnable fuel source into the tube such that the burnable fuel source travels into the housing and terminates at the tray and refractory bricks. The exit fan may be activated, which may draw air from the air inlet, through the tray where the burnable fuel source is located, past the deflector plate and the plurality of pipes, and out the air outlet. The burnable fuel source may be heated at least until a portion of the burnable fuel source ignites. The fuel source may then be burned such that air temperature within the housing increases. The heated air may pass through the ash collector and exit the apparatus. The circulating fan may be activated and may move ambient air through the plurality of pipes and out the front of the apparatus, heating the room where the apparatus is located. By so doing, clean air, as opposed to the air containing ash and particulates within the housing, may be heated and released into the room where the apparatus is located.

The present disclosure will now be described to provide an overall understanding of the principles of the structure, function, manufacture, and use of the devices and methods disclosed herein. One or more examples of the present disclosure are illustrated in the accompanying drawings. Those of ordinary skill in the art will understand that the devices and methods specifically described herein and illustrated in the accompanying drawings are non-limiting embodiments and that the scope of these embodiments is defined solely by the claims. The features illustrated or described in connection with one embodiment may be combined with the features of other embodiments. Such modifications and variations are intended to be included within the scope of the appended claims.

Additional details are described below with reference to several example embodiments.

Example Apparatuses

FIG. 1 illustrates an example of an apparatus for burning a burnable fuel source (100). The apparatus may resemble a wood stove that includes a container 102 configured to burn the fuel source. The container may include a door 104, which may be positioned on the front of the container 102. The door 104 may be at least partially made of glass such that a user may view the inside of the container 102. The door 104 may open to allow the user to access the interior of the container 102. A tube 106 may be positioned to extend through at least one wall of the container 102 and terminate therein.

Figure 2:
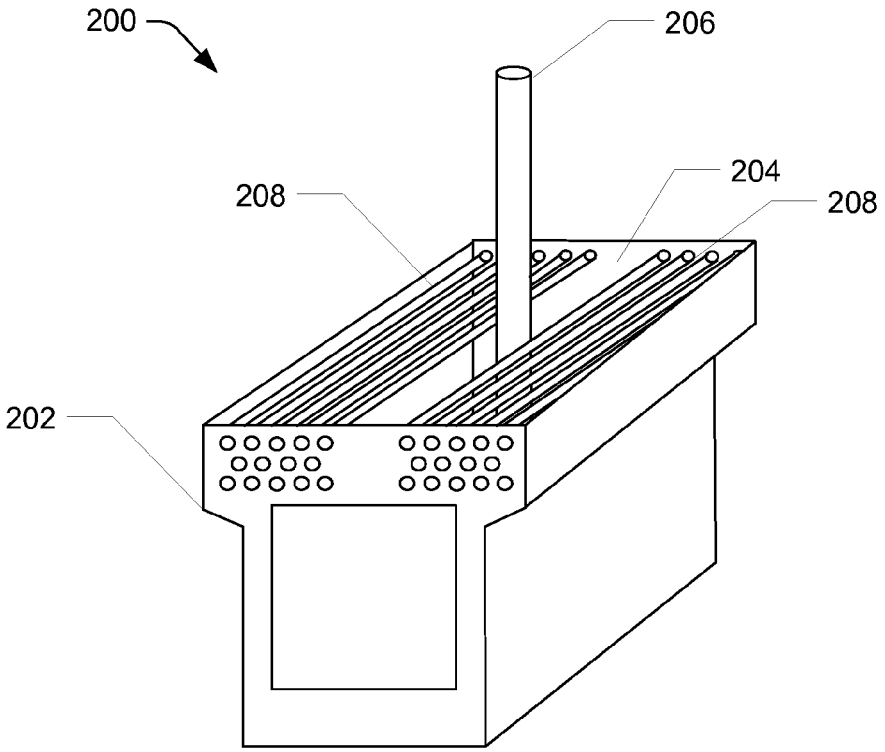
FIG. 2 illustrates a perspective view of an embodiment of an apparatus configured to burn a burnable fuel source with its top surface removed.

FIG. 2 illustrates an example embodiment of an apparatus for burning a burnable fuel source (200). In some embodiments, apparatus 200 may include a housing 202 defining a chamber 204. The housing 202 may be of various shapes and sizes to promote the burning of the burnable fuel source within the chamber 204. The embodiment shown in FIG. 2 depicts apparatus 200 with the top portion, or lid, of the housing 202 removed for better visualization of the components within the chamber 204. A tube 206 may extend through a wall of the housing 202, such as through the top portion as shown in FIG. 2, and be disposed at least partially within the chamber 204. The tube 206 may extend through the wall of the housing 202 at an angle, such as, for example a 30° angle. Additionally, the tube 206 may extend through multiple walls of the housing 202, such as, for example the conjunction of the top and side walls, or the tube 206 may extend through only a side portion of the housing 202. The tube 206 may accommodate the burnable fuel source. A plurality of pipes 208 may also be disposed within the chamber 204. As shown in FIG. 2, the plurality of pipes 208 may be positioned at or near the top portion of apparatus 200 on either or both sides of the tube 206. The number of pipes in the plurality of pipes 208 may vary and may number anywhere from one to more than one pipe. The plurality of pipes 208 may be a variety of sizes and shapes. For example, the plurality of pipes 208 may be cylindrical and may have varying diameters and lengths. Furthermore, the diameters and lengths of individual pipes of the plurality of pipes 208 may be uniform or may differ from each other. The plurality of pipes 208 may also be cuboids with varying heights, widths, and depths.

Figure 3:
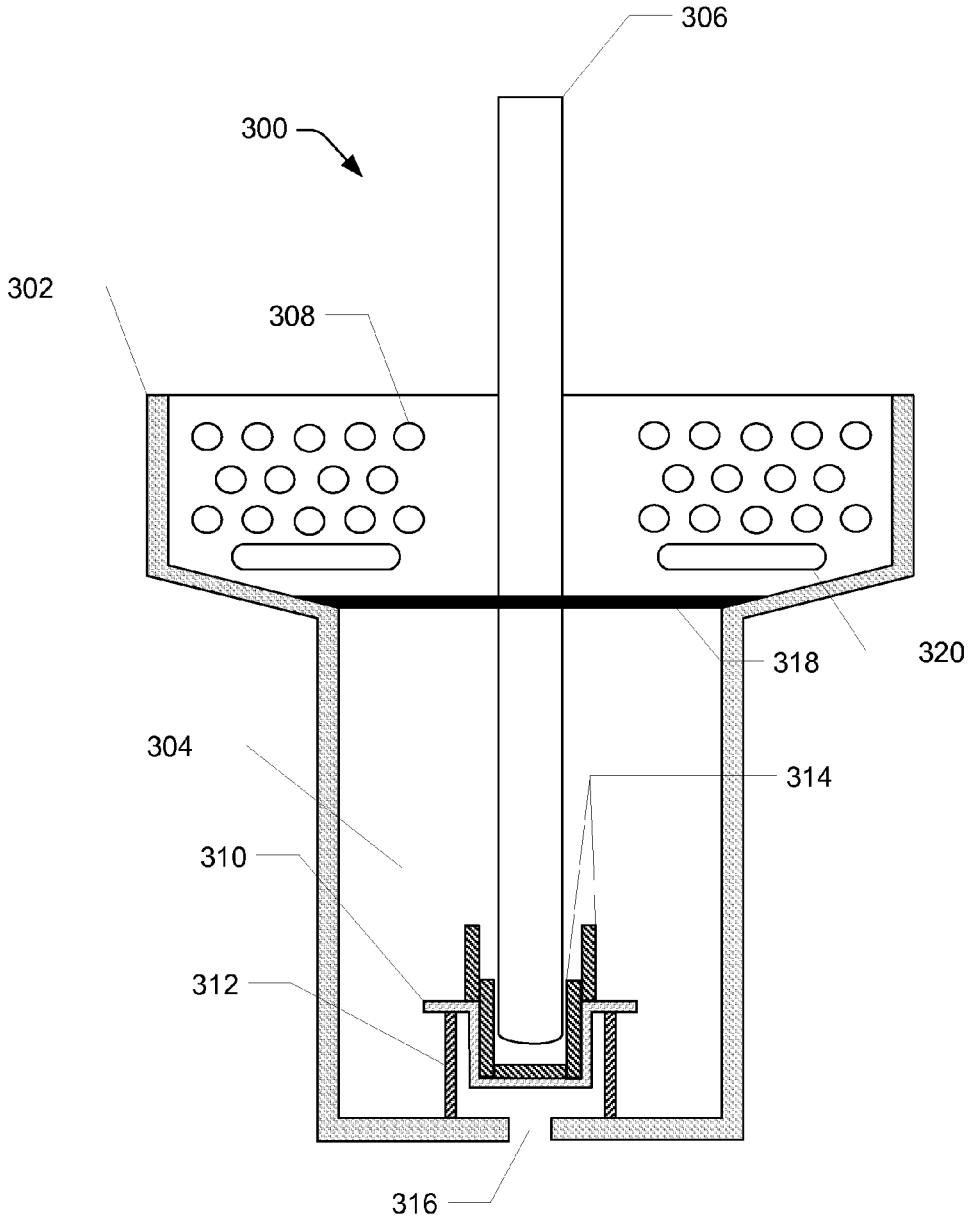
FIG. 3 illustrates a frontal, cross-sectional view of an embodiment of an apparatus configured to burn a burnable fuel source.

Turning to FIG. 3, a frontal, cross-sectional view of an embodiment of an apparatus for burning a burnable fuel source (300) is illustrated. Apparatus 300 may include a housing 302 defining a chamber 304. A tube 306 may extend through a wall of the housing 302, such as through the top portion as shown in FIG. 3, and be disposed at least partially within the chamber 304. The tube 306 may accommodate the burnable fuel source. A plurality of pipes 308 may also be disposed within the chamber 304. As shown in FIG. 3, the plurality of pipes 308 may be positioned at or near the top portion of apparatus 300 on either or both sides of the tube 306. The housing 302 may also comprise additional shells for heat shielding and/or clearance for surrounding objects.

Still referring to FIG. 3, a tray 310 may be disposed within the chamber 304. In some embodiments, the tray 310 may be positioned below the tube 306. A portion of the tube 306 may extend at least partially into the interior of the tray 310, or the tube 306 may be positioned above the tray 310. The tray 310 may be supported by one or more tray supports 312. The tray supports 312 may allow the tray 310 to rest on the tray supports 312. The tray supports 312 may allow the bottom portion of the tray 310 to stand off from the bottom wall of the housing 302. Tray supports 312 may also hold the tray 310 such that a gap is defined between the side walls of the tray 310 and the tray supports 312. The tray 310 may contain one or more flanges that may rest on the tray supports 312 when the tray 310 is in contact with the tray supports 312.

Also shown in FIG. 3, one or more refractory bricks 314 may be disposed on at least a portion of the tray 310. In some embodiments, the refractory bricks 314 may line the interior of the tray 310 and may also be placed on the top portion of the tray 310. The refractory bricks 314 may be made of any suitable materials. For example, in some embodiments, the refractory bricks 314 may be made of refractory ceramic materials or other materials designed to withstand high temperature while having low thermal conductivity. The refractory bricks 314 may also be known as fire bricks, and may be made from partially vitrified fireclay.

Still referring to FIG. 3, the housing 302 may include an air inlet 316, which may be disposed adjacent to the tray 310. In some embodiments, air may be drawn from the air inlet 316, past the bottom and sides of the tray 310, and into the interior of the tray 310 where the burnable fuel source is received. The air may be pre-heated when the air contacts the bottom and sides of the tray 310 when apparatus 300 is in use. Apparatus 300 may also include a deflector plate 318, which may be disposed within the chamber 304 and be sized to deflect air within the chamber toward the plurality of pipes 308. Apparatus 300 may also include one or more air outlets 320 via which air from within the chamber 304 exits the chamber 304.

Figure 4:
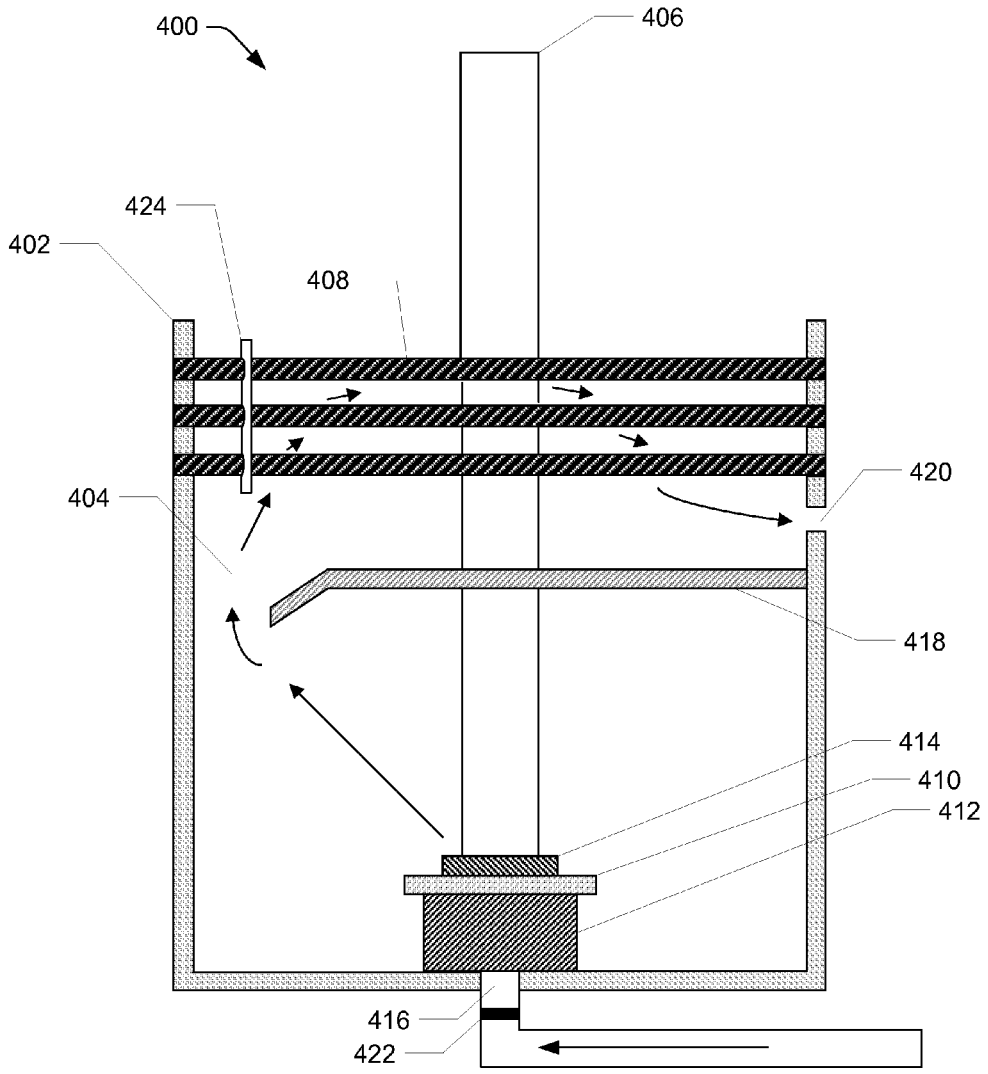
FIG. 4 illustrates a side, cross-sectional view of an embodiment of an apparatus configured to burn a burnable fuel source.

Referring now to FIG. 4, a side, cross-sectional view embodiment of an apparatus for burning a burnable fuel source (400) is illustrated. Apparatus 400 may contain the same or similar components as shown in FIG. 3. For example, apparatus 400 may include a housing 402 defining a chamber 404, a tube 406, a plurality of pipes 408, a tray 410, tray supports 412, refractory bricks 414, an air inlet 416, a deflector plate 418, and one or more air outlets 420. Apparatus 400 also depicts an air intake damper 422, which may increase or decrease air flow through the air inlet 416. The air intake damper 422 may be any mechanism that increases or decreases air flow through the air inlet 416. In some embodiments, the air intake damper 422 may be a circular mechanism sized to mimic the diameter of the air inlet 416 and configured to swivel between a closed position wherein the mechanism substantially blocks air flow to the air inlet 416, and an open position wherein the mechanism allows substantially unhindered air flow to the air inlet 416. The air intake damper 422 may be adjustable such that the mechanism may move between a closed position and an open position, or any partially open position in between a fully closed position and a fully open position. The air intake damper 422 may also be a sheet of material that is slidable between a closed position and an open position. Additionally, the air intake damper 422 may be a throttle valve, such as, for example, throttle valves used in automobiles. The throttle valve may open and close in response to an operator pushing on a throttle or similar mechanism. As shown in FIG. 4, apparatus 400 may be configured to draw air past the air intake damper 422 and through the air inlet 416. The air may then pass into the tray where the burnable fuel source is maintained, providing oxygen to the fuel source as the fuel source burns. The heated air, ash, and other contaminants produced by the burning fuel source may then be drawn upwards past the deflector plate 418 and into a top portion, also known as the heat cap, of the chamber 404. The heated air may contact the plurality of pipes 408 and exit the chamber 404 through the air outlet 420. FIG. 4 includes arrows showing the flow of air through apparatus 400.

Still referring to FIG. 4, apparatus 400 may also include a pipe sheath 424, which may surrounding a portion of the plurality of pipes 408 and be configured to move along the exterior of the plurality of pipes 408 such that the pipe sheath 424 makes contact with a portion of the plurality of pipes 408 when in motion. In some embodiments, a user may move the pipe sheath 424 along the plurality of pipes 408 in order to scrape or otherwise remove ash or other particles that may have built up on the plurality of pipes 408 from use of apparatus 400. In some embodiments, a level or other mechanism may be manipulated by the user to move the pipe sheath 424 along the plurality of pipes 408.

Figure 5:
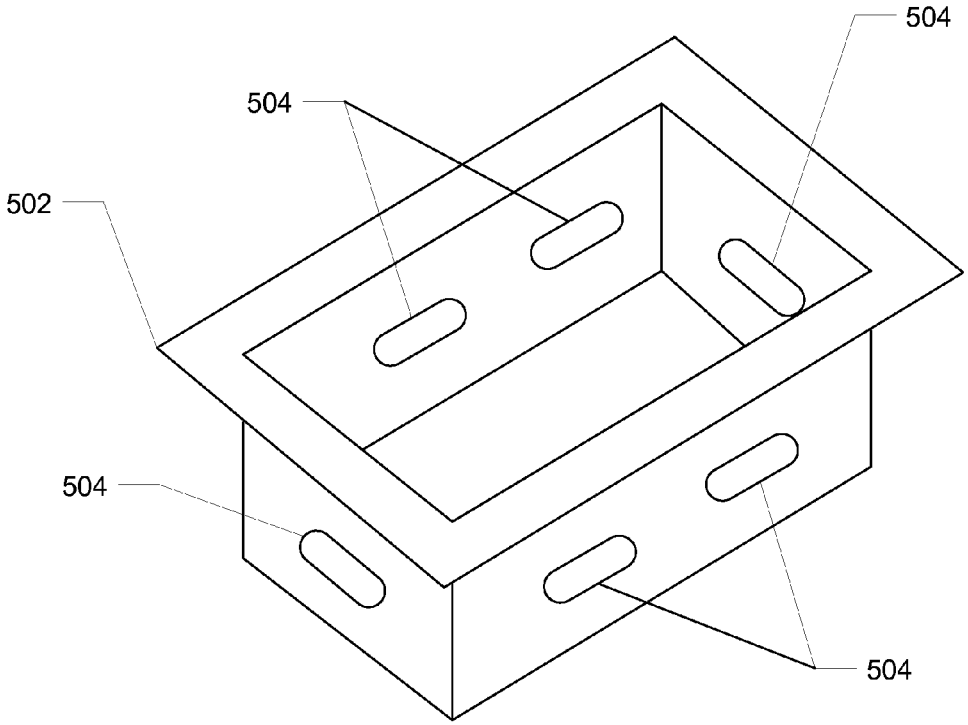
FIG. 5 illustrates a perspective view of a tray, as described herein.

Turning now to FIG. 5, a perspective view of an example tray 502 as described herein is illustrated. The tray 502 may include one or more holes 504. The holes 504 may be of various sizes and shapes, and may be situated on one or more sides of the tray 502. In the embodiment shown in FIG. 5, two holes 504 are situated on a first side of the tray 502, and two holes 504 are situated on a second side of the tray 502. However, holes 504 could also be situated on only the first side, only the second side, on other sides, or any combination thereof. Also, the number of holes 504 could be as few as one and as many as can fit in the walls of the tray 502. The positioning of the holes 504 may also vary. For example, the holes 504 may be positioned near the top of the tray 502, or near the bottom of the tray 502, or anywhere in between. In addition, the positioning of the holes 504 may be uniform (e.g., all near the top of the tray 502) or may vary in any given application (e.g., some positioned near the top of the tray 502 while others positioned near the bottom of the tray 502). In some embodiments, the holes 504 may be configured to allow air from the air inlet to move through the holes 504 and into the interior portion of the tray 502.

Figure 6:
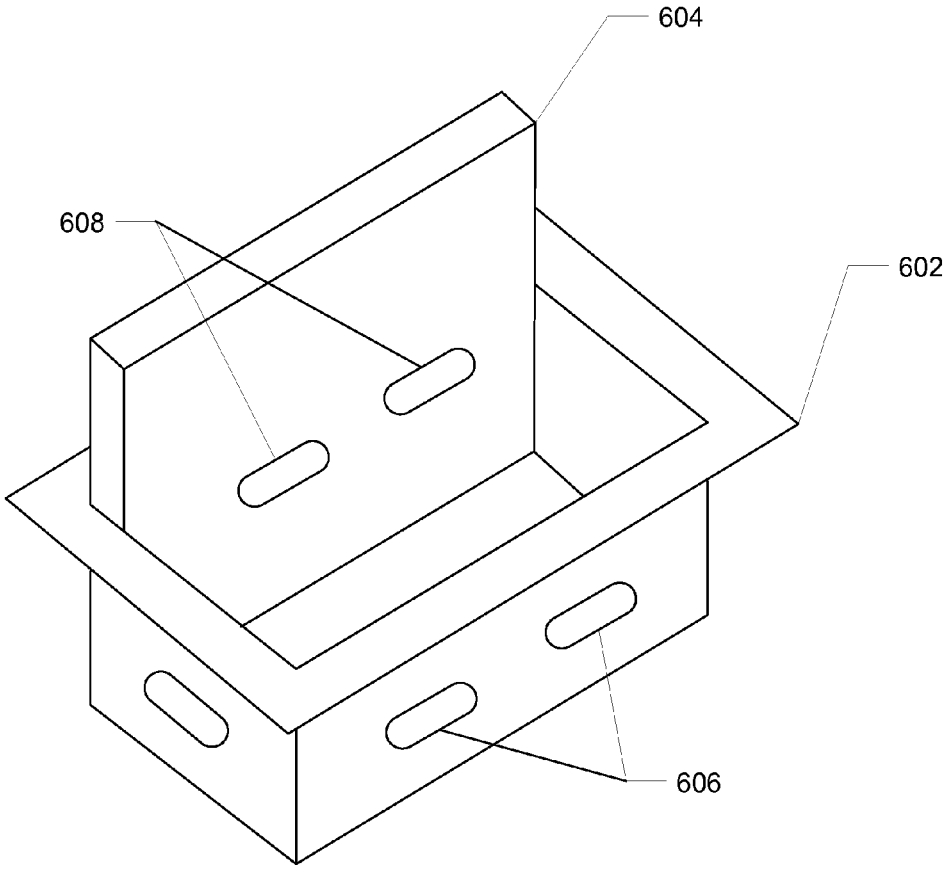
FIG. 6 illustrates a perspective view of a tray and a refractory brick, as described herein.

Turning to FIG. 6, a perspective view of an example tray 602 and an example refractory brick 604 is illustrated. As described above, the refractory brick 604 may be disposed on at least a portion of the tray 602. The refractory brick 604 may completely or partially line the inside portion of the tray 602 and may also be disposed on the top portion, or lip, of the tray 602. Like the tray depicted in FIG. 5, tray 602 in FIG. 6 may also have one or more holes 606. The refractory brick 604, likewise, may include one or more holes 608. The holes 608 in the refractory brick 604 may be the same size and shape, and have the same positioning, as the holes 606 in the tray 602. The holes 608 in the refractory brick 604 may also be of different size, shape, and positioning as the holes 606 in the tray 602. In use, referring back to FIG. 3, the air drawn from the air inlet 316 may pass through the holes 606 in the tray 602 and the holes 608 in the refractory brick 604 and enter the interior portion of the tray 602. The holes 606 and 608 in the refractory brick 604 may also maintain one or more tubes that extend through the holes 606 and the holes 504 in the tray 502.

Figure 7:
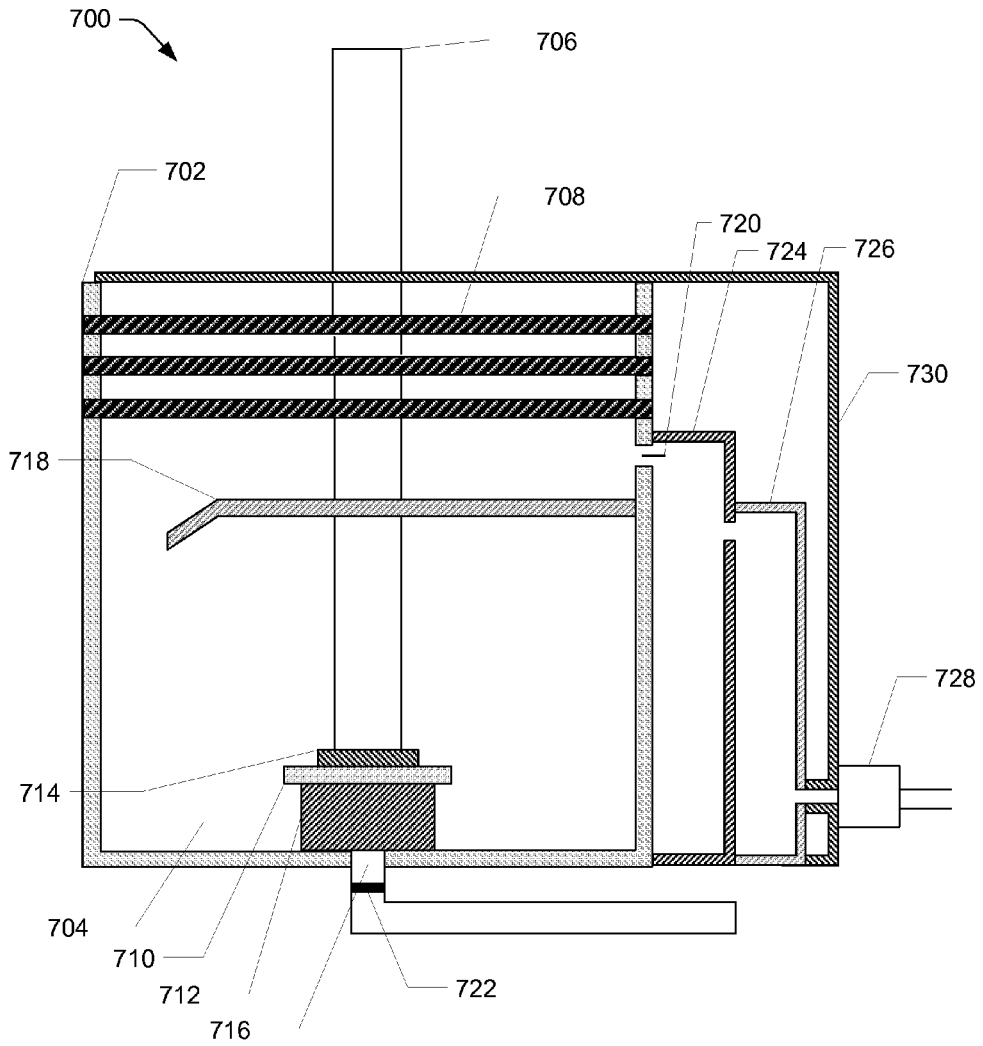
FIG. 7 illustrates a side, cross-sectional view of an embodiment of an apparatus configured to burn a burnable fuel source.

Referring now to FIG. 7, a side, cross-sectional view of an embodiment of an apparatus configured to burn a burnable fuel source (700) is illustrated. Apparatus 700 may contain the same or similar components as shown in FIG. 4. For example, apparatus 700 may include a housing 702 defining a chamber 704, a tube 706, a plurality of pipes 708, a tray 710, tray supports 712, refractory bricks 714, an air inlet 716, a deflector plate 718, one or more air outlets 720, and an air intake damper 722. Apparatus 700 also depicts a second housing 724 that may be coupled to the first housing 702. The second housing 724 may be positioned to accept air from the air outlet 720. Apparatus 700 also depicts a third housing 726, which may be coupled to the second housing 724. The third housing 726 may be positioned to accept air from the second housing 724. An exit fan 728 may be positioned to move air from within the chamber 704 through the second housing 724, through the third housing 726, and out of apparatus 700. The second housing 724 and the third housing 726 may be described as ash collectors. Within each ash collector, an array of plates may be positioned to increase the distance the air within the ash collector must travel to each the exit fan 728. The array of plates will be described in greater detail below with reference to FIGS. 9-10. In other embodiments, the second housing 724 may be a part of the first housing 702 and form a second chamber. In other embodiments, the third housing 726 may be coupled to the first housing 702, and the second housing 724 may be absent. The exit fan 728 may be coupled to the third housing 726, to the second housing 724, or to the first housing 702.

Still referring to FIG. 7, apparatus 700 may also include a shell 730 that may be coupled to at least a first portion of an exterior of the housing 702. The shell 730 may form a gap between a portion of the exterior of the housing 702 and the shell 730. As may be seen in FIG. 7, the gap between the housing 702 and the shell 730 may be located above the second housing 724 and the third housing 726, as well as on the side of the third housing 726. The shell 730 may extend over the top of housing 702 and may also cover a portion or all of the sides of housing 702. When the shell 730 covers the top and sides of housing 702, the apparatus may resemble apparatus 100 from FIG. 1. The shell 730 may serve to create a temperature buffer between the shell 730 and the first housing 702, second housing 724, and/or third housing 726. The shell 730 may also form a temperature buffer between the shell 730 and the side walls of the housing 702.

Figure 8:
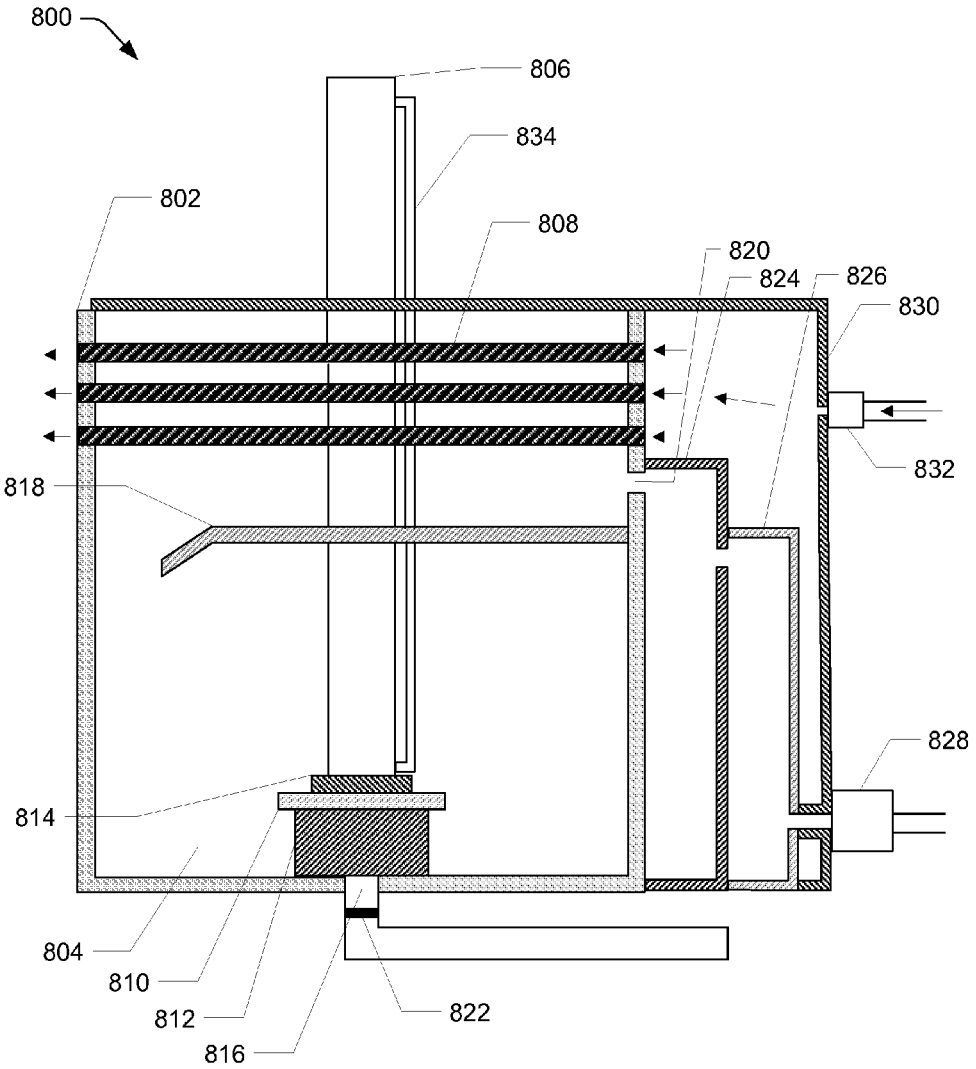
FIG. 8 illustrates a side, cross-sectional view of an embodiment of an apparatus configured to burn a burnable fuel source.

Referring now to FIG. 8, a side, cross-sectional view of an embodiment of an apparatus that burns a burnable fuel source (800) is illustrated. Apparatus 800 may contain the same or similar components as shown in FIG. 7. For example, apparatus 800 may include a housing 802 defining a chamber 804, a tube 806, a plurality of pipes 808, a tray 810, tray supports 812, refractory bricks 814, an air inlet 816, a deflector plate 818, one or more air outlets 820, an air intake damper 822, a second housing 824, a third housing 826, an exit fan 828, and a shell 830. Apparatus 800 may also include a circulating fan 832 that may be coupled to the shell 830 and may be positioned to move air from the gap between the housing 802 and the shell 830 through the plurality of pipes 808. As described above, the heated air from within the chamber 804 is drawn to the top portion of the housing 802 by the exit fan 830. As the heated air moves into the top portion of the housing 802, that heated air may contact the plurality of pipes 808, heating the plurality of pipes 808 and the air within the plurality of pipes 808. The circulating fan 832 circulates ambient air from outside apparatus 800 through the gap between the housing 802 and the shell 830 and through the plurality of pipes 808. As the air enters the gap and eventually the plurality of pipes 808, that air is heated. The heated air is pushed through the plurality of pipes 808 and out the end of the plurality of pipes 808. In one embodiment, the end of the plurality of pipes 808 is disposed on a first side of the front of apparatus 800, such that heated air is pushed out the front of apparatus 800 and into the space where apparatus 800 is located. FIG. 8 includes arrows showing the flow of air caused by the circulating fan 832.

FIG. 8 also illustrates an auxiliary tube 834 that may be coupled to the tube 806. The auxiliary tube 834 may provide a means of moving air from the top of the tube 806 to the bottom of the tube 806, or vice versa, when apparatus 800 is in use. Although not shown in the other Figures presented in this disclosure, auxiliary tube 834 may be included in any embodiment described and shown herein.

Figure 9:
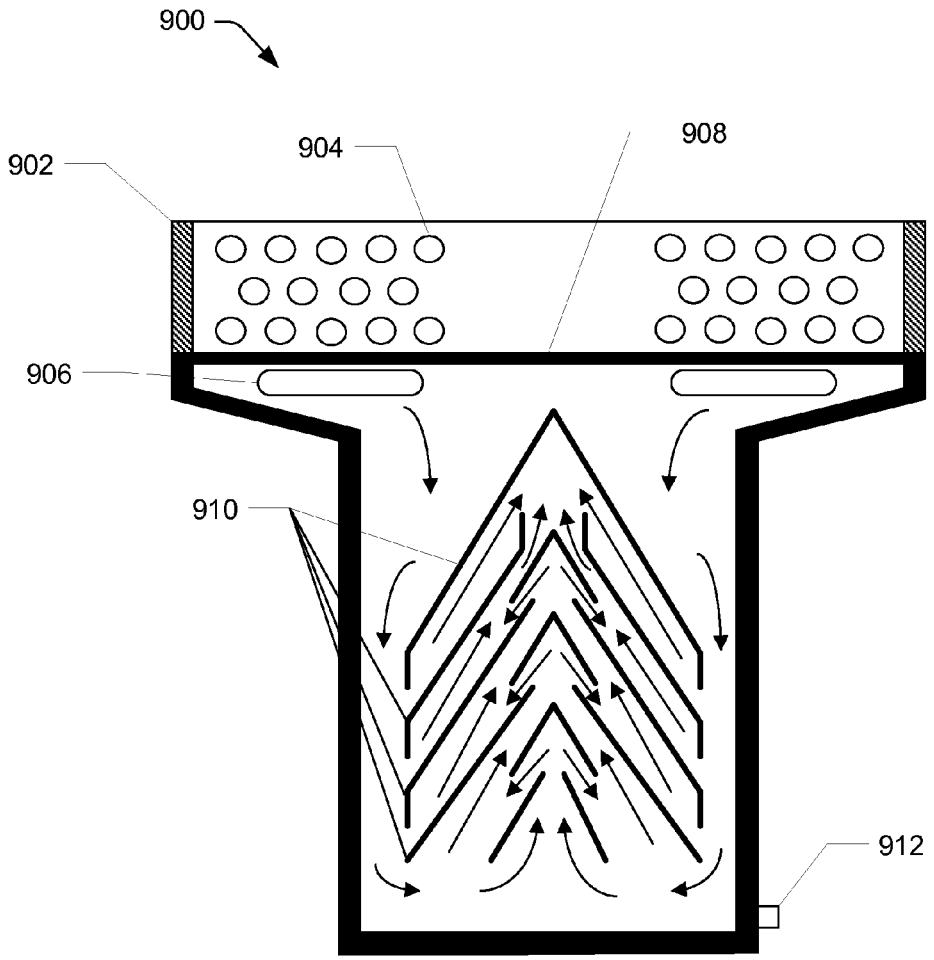
FIG. 9 illustrates a rear, cross-sectional view of an embodiment of an apparatus configured to burn a burnable fuel source.

Referring now to FIG. 9, a rear, cross-sectional view of one embodiment of an apparatus for burning a burnable fuel source (900) is illustrated. More specifically, apparatus 900 illustrates the rear of housing 802 from FIG. 8, and the cross-section is taken midway through the second housing 824 such that the interior of the second housing 824 is visible. Apparatus 900 may contain the same or similar components as shown in FIG. 8. For example, apparatus 900 may include a housing 902, a plurality of pipes 904, one or more air outlets 906, and a second housing 908. As may be seen in FIG. 9, an array of plates 910 may be disposed within the second housing 908. The array of plates 910 may be arranged in a number of different patterns to restrict the flow or otherwise increase the distance travelled of air flowing from the housing 902. Arrows have been provided in FIG. 9 to show an example of air flow from the one or more air outlets 906 through the second housing 908 past the array of plates 910. In some embodiments, the array of plates 910 may be arranged in a multiple chevron pattern wherein the array of plates 910 are arranged to create multiple chevrons, some of which may be narrower or wider than others, have vertexes pointing in the same or opposite directions, or have end "flaps." In some embodiments, the array of plates 910 may be arranged in a single chevron pattern. The array of plates 910 may collect or otherwise capture ash and other particles in the air as the air moves past the array of plates 910. The ash and other particles may stick to the array of plates 910, or may fall to the bottom of the second housing 908. An entry port 912 be situated in the second housing 908 to allow a user to suction or other remove ash and particulates from the second housing 908.

Figure 10:
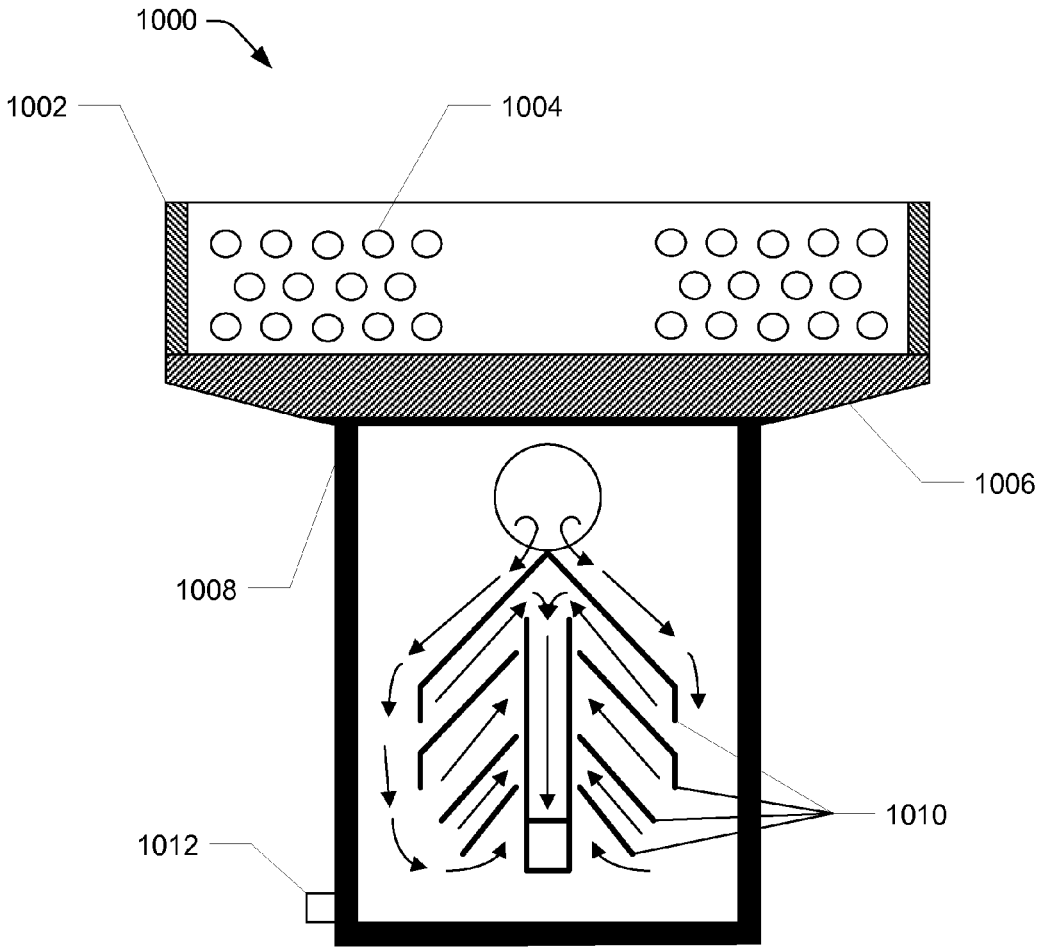
FIG. 10 illustrates a rear, cross-sectional view of an embodiment of an apparatus configured to burn a burnable fuel source.

Referring now to FIG. 10, a rear, cross-sectional view of one embodiment of an apparatus for burning a burnable fuel source (1000) is illustrated. More specifically, apparatus 1000 illustrates the rear of housing 802 from FIG. 8, and the cross-section is taken midway through the third housing 826 such that the interior of the third housing 826 is visible. Apparatus 1000 may contain the same or similar components as shown in FIG. 8. For example, apparatus 1000 may include a housing 1002, a plurality of pipes 1004, a second housing 1006, and a third housing 1008. As may be seen in FIG. 10, a second array of plates 1010 may be disposed within the third housing 1008. The second array of plates 1010 may be arranged in a number of different patterns to restrict the flow or otherwise increase the distance travelled of air flowing from the second housing 1006. Arrows have been provided in FIG. 10 to show an example of air flow from the second housing 1006, through the third housing 1008, and past the second array of plates 1010. In some embodiments, the second array of plates 1010 may be arranged in a multiple chevron pattern wherein the second array of plates 1010 is arranged to create multiple chevrons, some of which may be narrower or wider than others, have vertexes pointing in the same or opposite directions, or have end "flaps." The second array of plates 1010 may collect or otherwise capture ash and other particles in the air as the air moves past the second array of plates 1010. The ash and other particles may stick to the second array of plates 1010, or may fall to the bottom of the third housing 1008. A second entry port 1012 may be situated in the third housing 1008 to allow a user to suction or other remove ash from the third housing 1008.

Figure 11:
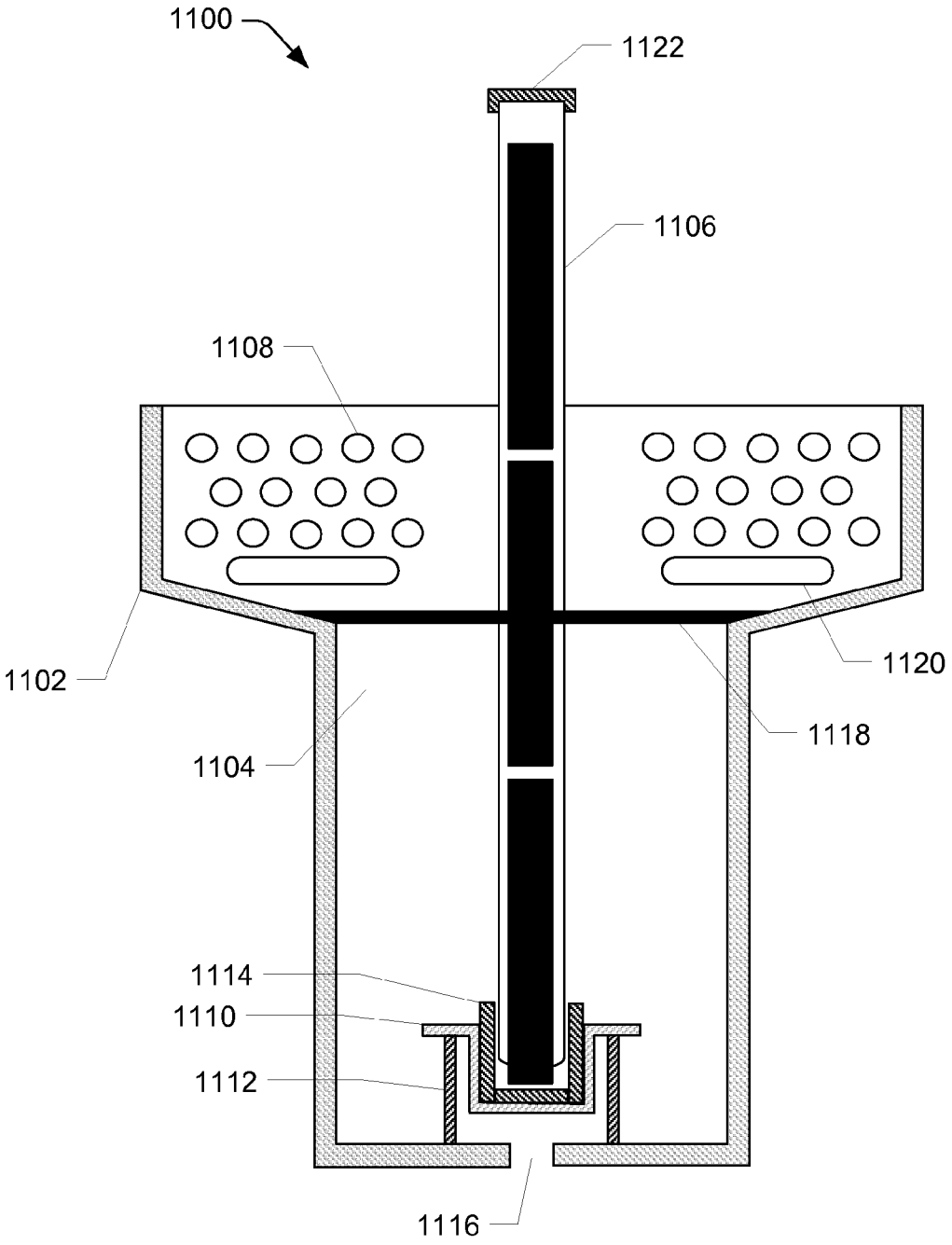
FIG. 11 illustrates a frontal, cross-sectional view of an embodiment of an apparatus configured to burn a burnable fuel source with fuel logs.

Referring now to FIG. 11, a frontal, cross-sectional view of an embodiment of an apparatus for burning a burnable fuel source (1100) is illustrated. Apparatus 1100 may contain the same or similar components as shown in FIG. 3. For example, apparatus 1100 may include a housing 1102 defining a chamber 1104, a tube 1106, a plurality of pipes 1108, a tray 1110, tray supports 1112, refractory bricks 1114, an air inlet 1116, a deflector plate 1118, and one or more air outlets 1120. Apparatus 1100 also depicts an example placement of a burnable fuel source in the tube 1106. By way of example, the burnable fuel source may include a plurality of fuel logs, such as densified fuel logs. The tube 1106 may be configured to hold the plurality of fuel logs simultaneously. Depending on the length of the tube 1106, the tube 1106 may be configured to hold one or more fuel logs simultaneously. In the example depicted in FIG. 11, the tube 1106 is configured to hold three fuel logs stacked end to end. The tube 1106 may be configured to hold any number of fuel logs, particularly given that the length of any given fuel log may range from less than one inch to multiple feet. The tube 1106 may also include a cap 1122 to close the distal end of the tube 1106. The tube 1106 may be positioned such that the burnable fuel source, fuel logs as depicted in FIG. 11, may travel via gravity from the distal end of the tube 1106 to the proximal end of the tube 1106, with the proximal end of the tube terminating within the housing 1102.

The components described above in the present disclosure and as shown in FIGS. 1-11 may be separate components coupled together, or may be produced as one component or as combined components. For example, referring to FIG. 8, the housing 802, second housing 824, and third housing 826 may be separate components or one component. Additionally, the tray 810 and the tray supports 812 may be separate components or one component. When the various components described in the present disclosure are separate components, some or all of the components may be releaseably coupled to the other components.

The apparatuses described herein may be of varying sizes and scales. For example, an apparatus designed for residential application may be of a smaller size and scale than an apparatus designed for commercial applications.

The presently disclosed apparatuses may be made of one or more of various materials, including but not limited to metal and/or plastic. When made of metal, apparatuses may be made of any metal with suitable strength and malleability, to create the apparatuses described herein. The various components of the apparatuses disclosed herein may have additional grooves, slots, indentations, and other components to facilitate the function of the apparatuses as described herein. For example, the apparatuses may contain a stand or footing component to set the apparatuses away from the floor of the space the apparatuses are located. Also by way of example, the apparatuses may include various piping and or ducting that vents air away from the apparatuses or facilitates air entering the apparatuses or components thereof.

The various components of the apparatuses disclosed herein may be made using techniques known to those having skill in the art of metal working, including, for example, by welding, tacking, and metal bending or shaping. The refractory bricks may be made of any materials, but in some embodiments, the refractory bricks may be made of refractory ceramic materials or other materials designed to withstand high temperature while having low thermal conductivity. The refractory bricks may also be known as fire bricks, and may be made from partially vitrified fireclay. The apparatuses may be installed in a home or other space by securing the apparatus to the floor of the space and creating holes in a neighboring wall, with one hole allowing for venting of air from within the apparatus out to the exterior of the space, and another hole allowing for air intake from the exterior of the space to the apparatus. Additional installation of fire protective materials, as may be required by government codes or regulations, may also be performed.

The apparatus described herein, in practice, have shown a marked improvement in efficiency and in reducing emissions. For example, a typical wood-burning stove may operate at an efficiency of 63-70%. Testing of the apparatus described herein reveals an efficiency of 77.8% to 85.3%. As such, the apparatuses described herein show a marked improvement over all previously tested wood heaters tested by the EPA.

Exemplary Method of Use

Figure 12:
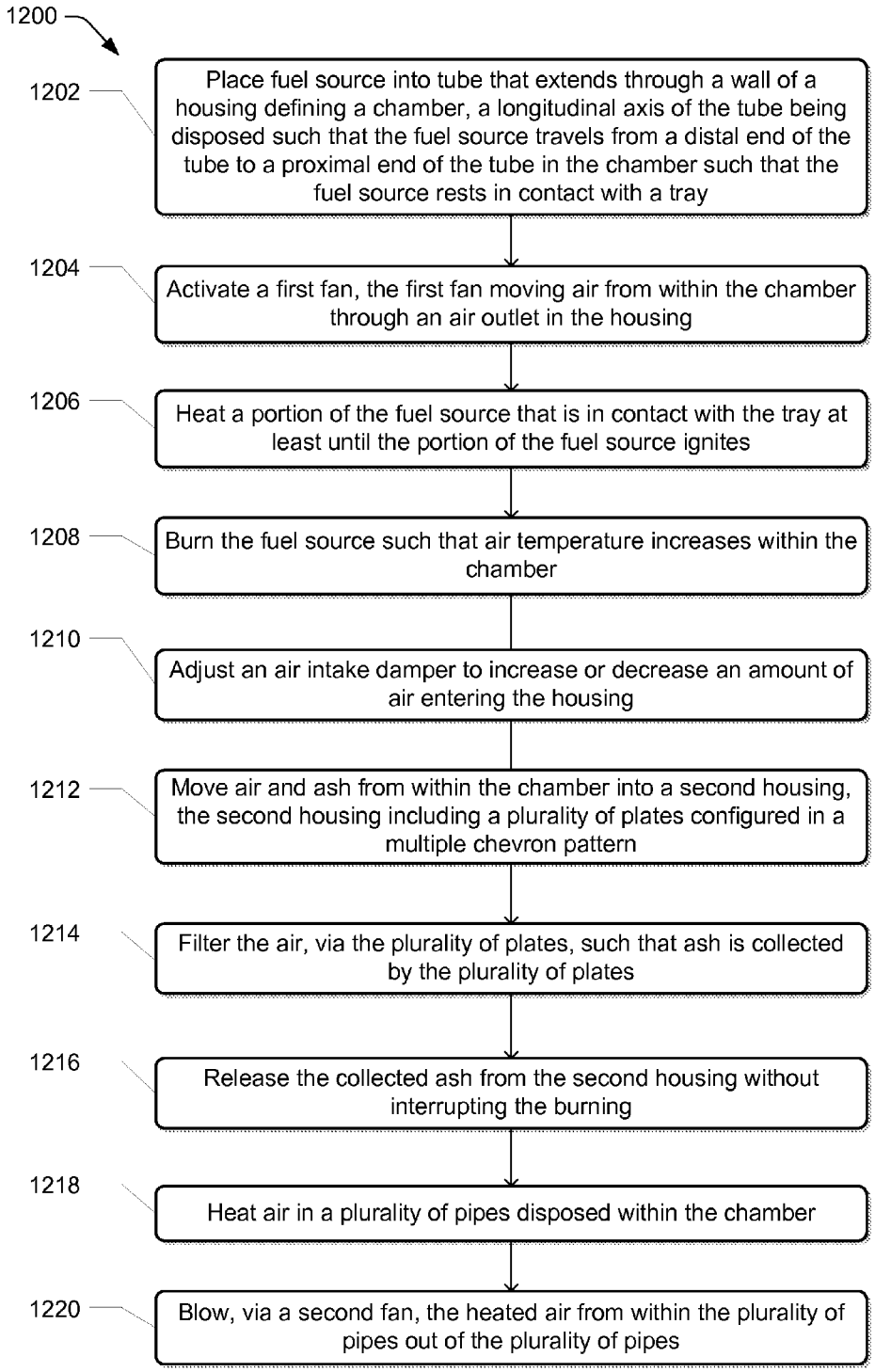
FIG. 12 illustrates a flow diagram of a method of operating an embodiment of an apparatus configured to burn a burnable fuel source.

FIG. 12 illustrates an example method for burning a burnable fuel source. Method 1200 is illustrated as a logical flow graph. The order in which the operations or steps are described is not intended to be construed as a limitation, and any number of the described operations may be combined in any order and/or in parallel to implement method 1200.

Turning now to FIG. 12, there is illustrated an exemplary method 1200 of burning a burnable fuel source.

At block 1202, an operator may place a fuel source into a tube that extends through a wall of a housing defining a chamber. A longitudinal axis of the tube may be disposed such that the fuel source may travel from a distal end of the tube to a proximal end of the tube in the chamber such that the fuel source rests in contact with a tray. In some embodiments, the fuel source may be a plurality of fuel logs, such as densified fuel logs. The plurality of fuel logs may be placed into the tube such that the plurality of fuel logs are arranged end to end and are maintained within the tube via gravity. Any number of fuel logs may be placed in the tube, and the fuel logs may vary in size and burning capability. In some embodiments, a sufficient quantity of fuel logs may be placed in the tube such that the burning of the fuel logs (described below in more detail) may last for a duration of at least 1 hour, at least 2 hours, at least 4 hours, at least 6 hours, at least 12 hours, at least 1 day, or several days.

At block 1204, the operator may activate a first fan. The first fan may move air from within the chamber through an air outlet in the housing. The fan may be configured to move at a constant speed or at variable speeds, which may be controlled by the operator. Activation of the first fan may be performed by flipping a switch, pressing a button, or any other action that would provide an electrical signal to the first fan to activate. The power of the fan may be any power sufficient enough to draw air from within the chamber through the air outlet in the housing.

At block 1206, the operator may heat a portion of the fuel source that is in contact with the tray at least until the portion of the fuel source ignites. In some embodiments, the heating may be performed by utilizing an external tool, such as, for example, a torch. A front door, or other access point, may be opened to provide the operator access to the area where the portion of the fuel source is in contact with the tray. The operator may contact the fuel source with flame from the torch for a sufficient period of time to ignite the fuel source such that the fuel source may burn without additional contact from the flame of the torch. In other embodiments, a torch, pilot flame, sparking device, or other mechanism may be included in the chamber. In such embodiments, the operator may electronically or manually activate the mechanism to initiate the heating.

At block 1208, the fuel source, having been ignited by the heating described in block 1206, may burn such that air temperature increases within the chamber. In some embodiments, the first fan described in block 1204 may move air from outside the chamber through an air inlet positioned near the tray described in block 1202. The air may provide the necessary oxygen content to allow the fuel source to burn. The burning of the fuel source may be restricted to the portion of the fuel source in contact with the tray. The burning may further be restricted to a "fire box" within the chamber. In some embodiments, a fire box may be the tray described in block 1202 lined, partially or completely, with refractory bricks. The refractory bricks may restrict the burning to only the area within the fire box, which may prevent fire from contacting some or all of the walls of the housing.

At block 1210, an air intake damper may be adjusted to increase or decrease the amount of air entering the housing through the air inlet. An operator may manipulate a lever or other mechanism to adjust the air intake damper. When the air intake damper is adjusted to increase the amount of air entering the housing through the air inlet, the burning may be intensified from the increased amount of oxygen being provided to the fire. When the air intake damper is adjusted to decrease the amount of air entering the housing through the air inlet, the burning may be reduced from the decreased amount of oxygen being provided to the fire. By adjusting the air intake damper, the operator may adjust the temperature of the air within the chamber. In an embodiment, an operator may adjust the air intake damper to allow for high heat within the chamber, which may allow the fire bricks to reach a threshold temperature that promotes heating of the fuel source. The operator may then adjust the air intake damper to decrease heat to promote a slower burning of the fuel source.

At block 1212, air and/or ash from the burning may be moved, for example, via the first fan, from within the chamber into a second housing. The second housing may include a plurality of plates configured in a pattern. The plurality of plates may be arranged in a number of different patterns to restrict the flow or otherwise increase the distance travelled of air flowing from the chamber. In some embodiments, the plurality of plates may be arranged in a multiple chevron pattern wherein the plurality of plates are arranged to create multiple chevrons, some of which may be narrower or wider than others, have vertexes pointing in the same or opposite directions, or have end "flaps."

At block 1214, the air and/or ash from the burning may be filtered, for example, via the plurality of plates described in block 1212. In some embodiments, ash and other particulates may be collected on the surface of the plurality of plates as the air carrying those particulates passes by the plates. The particulates may stick to the plurality of plates, or the particulates may fall to the bottom of the second housing. By so doing, the air moving from the chamber to the second housing may be filtered such that the air that is eventually expelled by the first fan contains less ash and particulates than the air within the chamber.

At block 1216, the operator may release the collected ash and particulates described in block 1214 from the second housing. This may be performed by accessing an entry port in the second housing. The entry port may be a cap, flap, or other covering that may be removed or otherwise manipulated to provide the operator with access to at least a portion of the second housing. The operator may then suction or otherwise remove the collected ash and particulates described in block 1214. In some embodiments, the release of the collected ash and particulates may be performed without interrupting the burning described in block 1208.

At block 1218, a plurality of pipes disposed within the chamber may be heated. In some embodiments, heating of the plurality of pipes may be accomplished by allowing the burning described in block 1208 to heat air within the chamber. The first fan described in block 1204 may direct the heated air past a deflector plate and toward the plurality of pipes. The heated air may contact the plurality of pipes, which may cause the plurality of pipes to be heated. Heating of the plurality of pipes may cause the temperature of the air within the plurality of pipes to increase.

At block 1220, the operator may activate a second fan. The second fan may blow the heated air from within the plurality of pipes (as described in block 1218) out of the plurality of pipes. In some embodiments, the second fan may draw ambient air from the exterior of the chamber through the plurality of pipes. This ambient air may be separate from the air being heated within the chamber. As the ambient air passes through the plurality of pipes, the heated plurality of pipes may cause the temperature of the ambient air to increase. The force from the second fan may continue to move the now heated air through the plurality of pipes and out the end of the plurality of pipes. In embodiments where the chamber has a cover, air may be present between the cover and the chamber. The air between the cover and the chamber may be heated by radiant heating from the chamber, and this air may also be blown through the plurality of pipes by the second fan. In some embodiments, the plurality of pipes may be configured such that the air expelled from the plurality of pipes exits through a front side of the housing. The heated expelled air may enter the space where the housing is located and heat that space.

CONCLUSION

Although the application describes embodiments having specific structural features and/or methodological acts, it is to be understood that the claims are not necessarily limited to the specific features or acts described. Rather, the specific features and acts are merely illustrative some embodiments that fall within the scope of the claims of the application.

What is claimed is:

1. An apparatus comprising:

a housing defining a chamber;

a tube extending through the housing and disposed at least partially within the chamber of the housing, the tube accommodating a burnable fuel source;

a tray disposed within the chamber and accommodating at least a portion of the burnable fuel source when received within the tube;

a refractory brick disposed on at least a portion of the tray;

a plurality of pipes disposed within the housing such that, upon actuation of the apparatus, heat from the burnable fuel source contacts the plurality of pipes;

an air outlet in the first housing configured to allow air from within the chamber to exit the chamber; and an exit fan positioned to move air from within the chamber through the air outlet.

2. The apparatus of claim 1, wherein the fuel source includes a plurality of fuel logs, and wherein the tube is configured to hold the plurality of fuel logs simultaneously.

3. The apparatus of claim 1, further comprising:

an air inlet in the housing, the air inlet disposed adjacent to the tray.

4. The apparatus of claim 3, further comprising:

an air intake damper disposed in the air inlet and configured to adjust air flow through the air inlet.

5. The apparatus of claim 1, further comprising:

a deflector plate disposed within the chamber and sized to deflect air within the chamber toward the plurality of pipes.

6. The apparatus of claim 1, further comprising:

a pipe sheath surrounding a portion of the plurality of pipes and configured to move along the exterior of the plurality of pipes such that the pipe sheath makes contact with the portion of the plurality of pipes when in motion.

7. An apparatus comprising:

a housing defining a chamber;

a tube extending through at least one side of the housing, wherein the tube is sized to receive and hold a burnable fuel source, wherein the tube is positioned such that the burnable fuel source travels via gravity from a distal end of the tube to a proximal end of the tube, the proximal end of the tube terminating within the housing;

an opening in a wall of the housing, the opening defining an air inlet;

a tray disposed within the chamber and adjacent to the air inlet;

a tray support disposed within the chamber and configured to hold at least a portion of the tray away from the wall of the housing;

a refractory brick disposed on at least a portion of the tray;

a plurality of pipes disposed within the housing such that, upon actuation of the apparatus, heat from the burnable fuel source contacts the plurality of pipes; and an air outlet in the housing configured to allow air from within the chamber to exit the chamber.

8. The apparatus of claim 7, further comprising:

a shell coupled to at least a first portion of an exterior of the housing, the shell forming a gap between a second portion of the exterior of the housing and the shell.

9. The apparatus of claim 8, further comprising:

a circulating fan coupled to the shell and positioned to move air from the gap through the plurality of pipes.

10. The apparatus of claim 7, further comprising:

a first hole in a side portion of the tray; and a second hole in the refractory brick, the second hole and the first hole allowing air to flow from the air inlet, through the first hole and the second hole, and into an interior portion of the tray.

11. The apparatus of claim 7, wherein the housing is a first housing and the apparatus further comprises:

a second housing coupled to the first housing, the second housing positioned to accept air from the air outlet; and an array of plates disposed within the second housing and forming a multiple chevron pattern.

12. The apparatus of claim 11, further comprising:

a third housing coupled to the second housing, the third housing positioned to accept air from the second housing; and a second array of plates disposed within the third housing and forming a multiple chevron pattern.

13. A method comprising:

placing a fuel source into a tube that extends through a wall of a housing defining a chamber, a longitudinal axis of the tube being disposed such that the fuel source travels from a distal end of the tube to a proximal end of the tube in the chamber such that the fuel source rests in contact with a tray;

activating a first fan, the first fan moving air from within the chamber through an air outlet in the housing;

heating a portion of the fuel source that is in contact with the tray at least until the portion of the fuel source ignites;

burning the fuel source such that air temperature increases within the chamber; and adjusting an air intake damper to at least one of increase or decrease an amount of air entering the housing.

14. The method of claim 13, wherein the fuel source is a plurality of fuel logs, and further comprising:

placing the plurality of fuel logs into the tube such that the plurality of fuel logs are arranged end to end and are maintained within the tube via gravity.

15. The method of claim 14, wherein the placing the plurality of fuel logs into the tube includes placing a quantity of fuel logs such that a duration of the burning is at least 12 hours.

16. The method of claim 13, further comprising:

heating air in a plurality of pipes disposed within the chamber; and blowing, via a second fan, the heated air from within the plurality of pipes out of the plurality of pipes.

17. The method of claim 13, wherein the housing is a first housing and further comprising:

moving air and ash from within the chamber into a second housing, the second housing including a plurality of plates configured in a multiple chevron pattern;

filtering the air, via the plurality of plates, such that ash is collected by the plurality of plates; and releasing the collected ash from the second housing without interrupting the burning.

* * * * *